US005299403A

United States Patent [19]

Fentz

[11] Patent Number: 5,299,403

[45] Date of Patent: Apr. 5, 1994

[54] INSULATION FASTENER

[75] Inventor: Ronald E. Fentz, Greenwood, Ind.

[73] Assignee: Lissco Products, Inc., Greenwood, Ind.

[21] Appl. No.: 870,678

[22] Filed: Apr. 17, 1992

[51] Int. Cl.[5] ..... E04B 2/30

[52] U.S. Cl. ..... 52/404; 52/745.12; 52/714; 52/379

[58] Field of Search ..... 52/357, 358, 359, 360, 52/361, 362, 363, 379, 509, 764, 404, 383, 583, 405, 714, 715, 713, 745.21

[56] References Cited

U.S. PATENT DOCUMENTS

| | | | |
|---|---|---|---|
| 1,187,918 | 6/1916 | Meyer . | |
| 2,016,968 | 10/1935 | Marble . | |
| 2,375,384 | 5/1945 | Putnam . | |
| 2,528,205 | 10/1950 | Benevento . | |
| 2,779,978 | 2/1957 | Sundelin et al. | 52/512 |
| 2,931,215 | 4/1960 | Rose . | |
| 3,299,597 | 1/1967 | Davey . | |
| 3,353,322 | 11/1967 | Guddal | 52/309.12 |
| 3,359,701 | 12/1967 | Schneller | 52/363 |
| 3,511,127 | 5/1970 | Gisondi | 52/362 |
| 3,972,168 | 8/1976 | Allen . | |
| 4,112,636 | 9/1978 | Hays | 52/359 |
| 4,291,514 | 9/1981 | Harvey | 52/509 |
| 4,869,038 | 9/1989 | Catani . | |
| 5,060,441 | 10/1991 | Pichette . | |

FOREIGN PATENT DOCUMENTS

| | | | |
|---|---|---|---|
| 2222425 | 11/1973 | Fed. Rep. of Germany | 52/714 |
| 2730525 | 1/1979 | Fed. Rep. of Germany | 52/509 |
| 2903897 | 8/1980 | Fed. Rep. of Germany . | |
| 2190938 | 12/1987 | United Kingdom | 52/379 |

*Primary Examiner*—Carl D. Friedman
*Assistant Examiner*—Winnie Yip
*Attorney, Agent, or Firm*—Barnes & Thornburg

[57] ABSTRACT

An insulation fastener and method for supporting insulation on a block wall is provided. The fastener has one end that is anchored to a block in the wall and another end that pierces the insulation. The anchoring end is positioned to lie inside a hollow inner core of the block.

22 Claims, 3 Drawing Sheets

INSULATION FASTENER

BACKGROUND AND SUMMARY OF THE INVENTION

This invention relates generally to building structures, and particularly to devices for fastening panels or sheets of material to walls. More particularly, this invention relates to a fastener that can be anchored to a wall and operated to pierce an insulation panel or the like and hold the panel flat against the wall.

Many modern homes are built atop crawl spaces. In order to make the structure more thermally efficient, insulation panels are generally installed on a wall bordering the crawl space. Typically, a two or four foot by eight foot flat sheet of one-half to three inch thick insulation material is cut as necessary to provide each insulation panel. In most cases, the crawl space is insulated by attaching several insulation panels to an inner surface of the foundation to lie in the crawl space. However, in some applications, it is desirable to attach one or more insulation panels to an exterior surface of the foundation or other part of a building.

It is a conventional practice to glue an insulation panel to the inner surface of a concrete block foundation so that the panel is held in place on the foundation to insulate the crawl space. Often, the top edge of the insulation panel is nailed to the wooden top plate mounted on the top course of concrete block used to provide the foundation. As a result of gluing and nailing, the insulation panel installation process tends to be very time consuming, and therefore expensive. Furthermore, the glue-wall bond is susceptible to deterioration due to exposure to moisture, which deterioration can cause the insulation to separate from the wall. If the crawl space should become flooded, the glue used to affix the panel to the wall may fail causing the insulation panel to separate from the wall. When that happens, the insulation contractor must be called back to the building site and asked to replace or repair the insulation, at additional cost.

An improved fastener is needed that will allow for faster, more reliable installation of insulation panels or the like and that is not susceptible to failure upon exposure of the fastener to moisture. Such a fastener would be a substantial improvement over conventional methods.

Mechanical insulation fastening systems are known. See, for example, German Patent Application No. 23 03 897 to Schuhmann, and U.S. Pat. No. 4,867,038 to Catani. Many known mechanical fasteners are cumbersome to use and difficult to anchor to a wall. A fastener that could be adapted in the field to anchor to any block foundation quickly and easily would be an improvement over conventional mechanical fasteners which use bolts or wire reinforcements to anchor the fastener in place.

According to the present invention, an insulation fastener is provided for attaching insulation to a block in a wall, where the block has a top and an inner core. The fastener includes means for piercing the insulation and means for anchoring the fastener to the block, with the anchoring means being attached to the piercing means. The anchoring means includes a first segment positioned against the block and inside the inner core and a second segment positioned adjacent to the top of the block. The second segment is disposed between the first segment and the piercing means.

In preferred embodiments, the anchoring means has a third segment extending orthogonally from the second segment, and the first, second, and third segments cooperate to define a generally U-shaped channel. The U-shaped channel can be inverted.

The piercing means includes a flange that extends orthogonally from the third segment. It is tapered to converge from a maximum width at one end adjacent to the third segment to a minimum width at another end of the flange.

A method of using an insulation fastener according to the present invention uses a construction block wherein the block has a wall and an inner core. The wall has an inner face adjacent to the inner core, an outer face, and a top face. The fastener has first, second, and third segments and a piercing flange.

To practice the method, the fastener is positioned adjacent to the block so that the second segment is adjacent to the top face and the third segment is adjacent to the front face. The first segment is bent into the inner core so that the first segment is positioned adjacent to the inner face of the block. Insulation is pushed against the fastener so that the piercing flange penetrates the insulation. After the piercing flange has penetrated the insulation, a washer is slid over the piercing flange and positioned so as to abut the outer facing surface of the insulation panel. An end portion of the piercing flange is bent to retain the washer in position and provide a mechanical lock to hold the insulation panel in position against the wall.

By providing a small, compact fastener that is anchored to a wall and which permanently couples the insulation panels to the wall, the present invention provides a faster and more economical means to attach insulation panels to a wall. By using a mechanical attachment rather than glue, which deteriorates, the present invention holds the insulation tightly to the block wall and thereby improves heat efficiency. Since there is no need to apply glue to the surface of the insulation and no need to nail the insulation to the top plate, installation is faster, and therefore cheaper. Furthermore, by providing an attachment means that does not deteriorate and subsequently release the insulation, the invention eliminates contractor call-backs to replace insulation, thereby decreasing the overall cost of installing the insulation.

By providing a fastener that is installed by manually bending a first leg into position, the present invention provides for faster and easier installation while obviating the need for additional tools and materials. Furthermore, manual bending of the first leg ensures that the fastener of the present invention is easily adaptable to a wide range of block sizes without the need of bolts or wire reinforcements to anchor the fastener in place.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
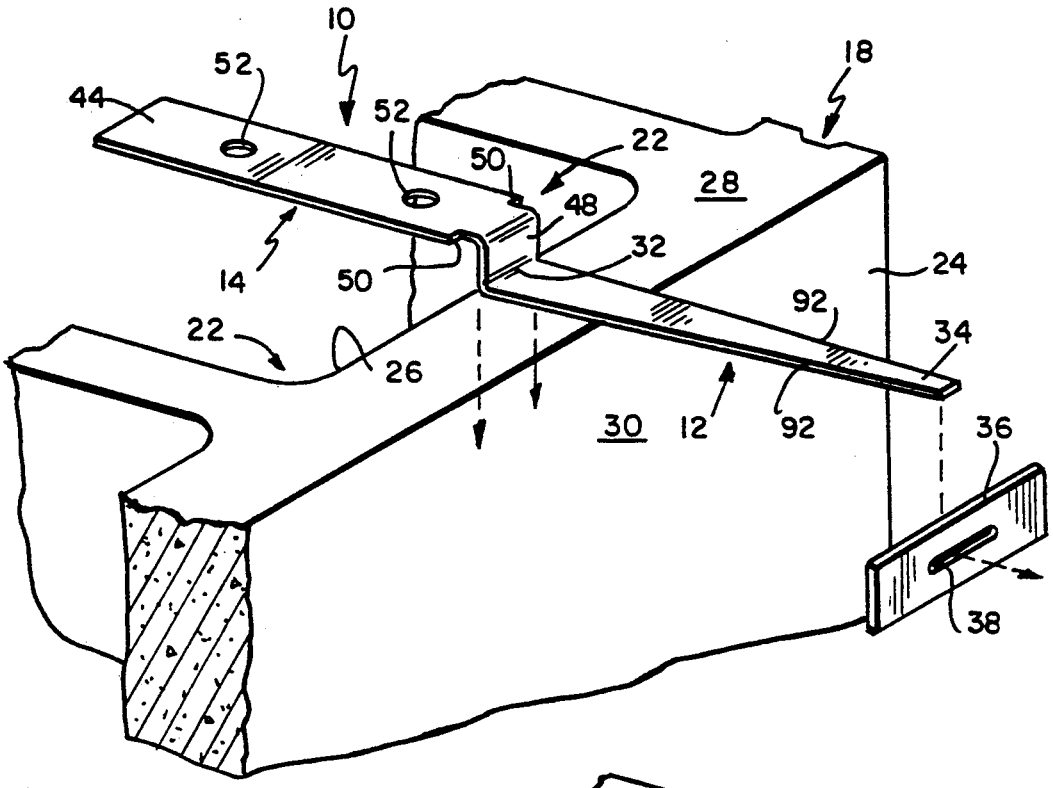
FIG. 1 is a perspective view of a fastener in accordance with the present invention positioned to lie in spaced-apart relation to a construction block just before the fastener is mounted on and anchored to the construction block.

An insulation fastener 10, as shown in FIG. 1, comprises a continuous piece of material formed to include a panel piercing flange 12 and an anchoring flange 14. The panel piercing flange 12 is designed to easily penetrate a panel of insulation 16 or like material and mechanically couple the insulation 16 to the fastener 10. The novel anchoring flange 14 is designed to provide a fast and easy way to anchor the fastener 10 to a block 18 in a wall 20. The anchoring flange 14 and panel piercing flange 12 thereby advantageously cooperate to permanently attach an insulation panel 16 to the wall 20. As presently envisioned, the insulation 16 fastener 10 of the present invention is constructed of 22-gauge steel. However, other gauges and other metals or materials may be suitable for use.

The fastener 10 is designed for use with a block 18 of the type generally used in the construction of a foundation wall 20 of a home. Typically, a block 18 comprises an inner core 22 and an outer wall 24. The outer wall 24 has an inner face 26 adjacent the inner core 22, a top face 28, and an outer face 30.

Figure 2:
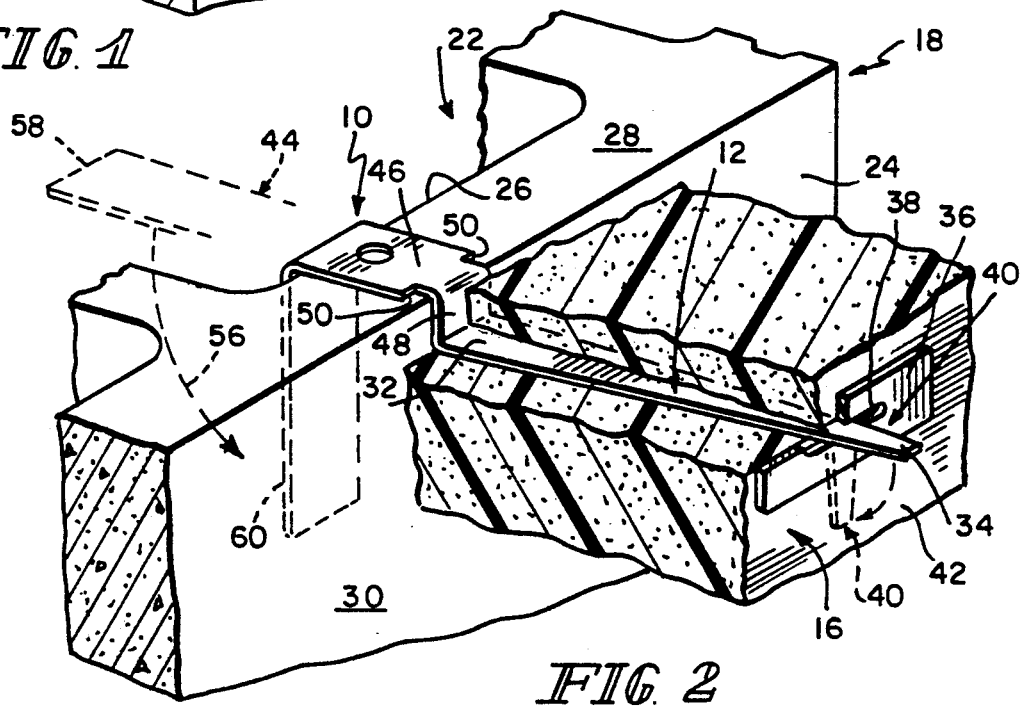
FIG. 2 is a view similar to FIG. 1 showing the insulation fastener after it has been deformed to anchor to a portion of the fastener to the construction block and pushed through the soft insulation panel.

The panel piercing flange 12 adjoins, and extends orthogonally from, the anchoring flange 14. Panel piercing flange 12 has side walls 92 that continuously converge from a maximum separation at a first end 32 adjacent the anchoring flange 14 to a minimum separation at the other end 34. Advantageously, the resulting taper of the panel piercing flange 12 facilitates penetration of the insulation panel 16 by the panel piercing flange 12. A washer 36 having a rectangular aperture 38 is formed to cooperate with the panel piercing flange 12. After the fastener 10 has been installed on a block 18, the insulation panel 16 is pushed toward the block 18 causing the panel piercing flange 12 to penetrate the insulation panel 16, as shown in FIG. 2. The panel piercing flange 12 has sufficient length to extend beyond the outer face 42 of the insulation panel 16.

The washer 36 is placed over the panel piercing flange 12 and positioned to lie adjacent to the outer face 42 of the insulation 16. The rectangular aperture 38 is sized to fit over the maximum width of the tapered panel piercing flange 12. Advantageously, this allows the washer 36 to engage the panel piercing flange 12 regardless of the thickness of insulation panel 16 used. A washer retaining tab 40 formed in the end 34 of the panel piercing flange 12 is bent upwardly or downwardly to hold the washer 36 in position against the insulation panel 16. The washer 36 and washer retaining tab 40 cooperate to form a mechanical coupler to hold the insulation 16 to the fastener 10. Advantageously, this mechanical coupler will not deteriorate as will a glue joint.

The anchoring flange 14 is formed to include a first segment 44, a second segment 46, and a third segment 48. The third segment 48 adjoins the panel piercing flange 12 and extends orthogonally therefrom. The second segment 46 extends orthogonally from the third segment 48. Together, the second segment 46 and the third segment 48 form an alignment mechanism for quickly, easily, and accurately positioning the fastener 10 on the block 18. The third segment 48 is positioned adjacent to the outer face 30 of a block 18 and the second segment 46 is positioned adjacent to the top face 28 of the block 18. Notches 50 are formed in the second segment 46 and define a discontinuity in width between the second segment 46 and the third segment 48. The anchoring flange 14 is also formed to include a plurality of apertures 52 for receiving masonry nails 54 or bolts.

The first segment 44 extends from the second segment 46. When the second segment 46 and third segment 48 are in position, the first segment 44 is bent down from an initial position, as shown in dotted lines at 58 in FIG. 2, into the inner core 22 of the block 18 along path 56, as shown in FIG. 2. The first segment 44 is positioned adjacent to the inner face 26 of the outer wall 24 as shown in dotted lines at 60 in FIG. 2. In this manner, the first, second, and third segments 44, 46, and 48, respectively, advantageously cooperate to form an inverted U-shaped channel that grips the outer wall 24 of the block 18 and provides a positive mechanical anchor that attaches the fastener 10 to the wall 20. By allowing for manually bending the novel anchoring flange 14 into position, the fastener 10 advantageously provides faster, easier, and less costly installation without tools, and allows one size fastener 10 to fit all block sizes.

Generally, the foundation wall 20 is formed by laying a series of blocks 18 down in a horizontal course 62, laying mortar 64 along the top faces 28 of the blocks 18, and laying another course 66 on top of course 62. The process is repeated until the desired height for the wall 20 has been reached.

Figure 4:
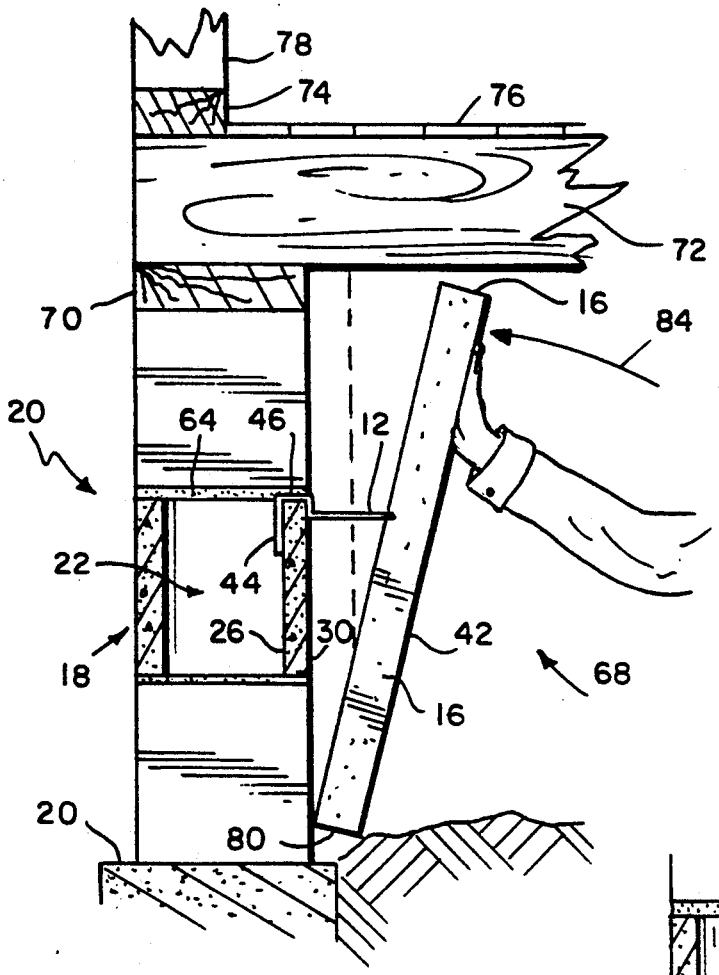
FIG. 4 is a sectional elevation view showing an insulation panel as it is being pivoted toward the inner surface of a three course construction block foundation to engage the tapered end of a fastener anchored to the concrete block foundation.

In a typical construction setting, as shown in FIG. 4, block wall 20 is built to define a crawl space 68 and support a top plate 70 which in turn supports the floor joists 72. The sole plate 74 is supported by the floor joists 72 and in turn supports the studs 78. Floor boards 76 are laid transversely across the top of the floor joists 72.

Figure 3:
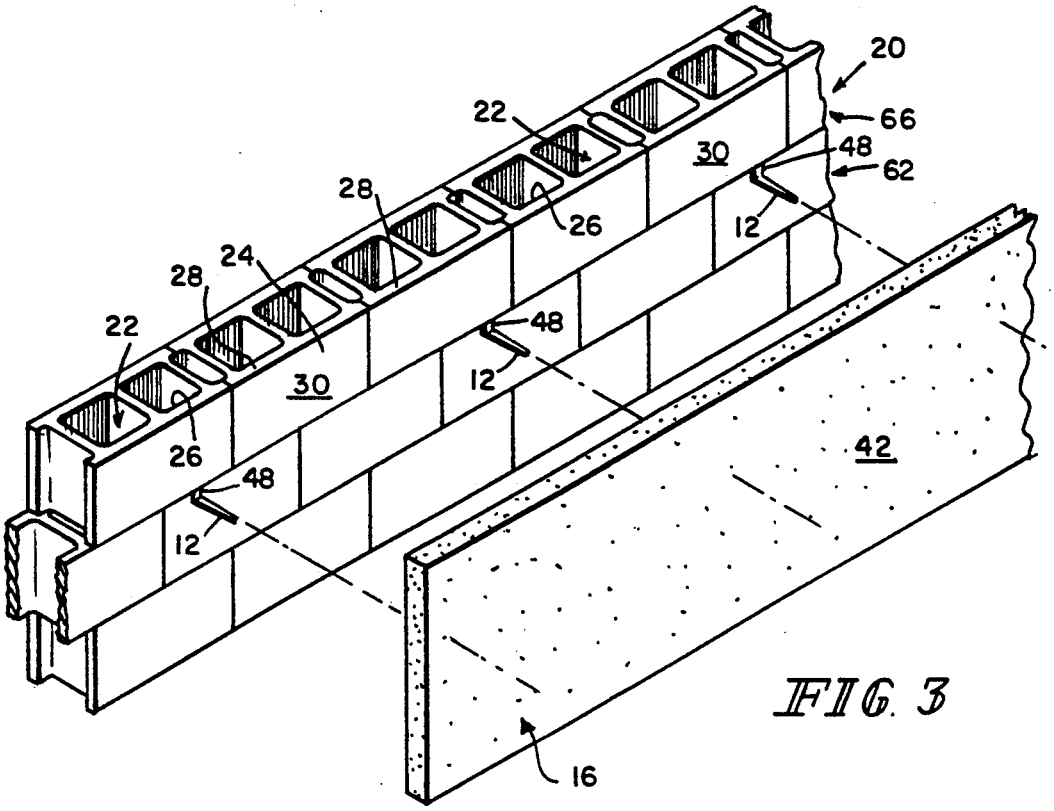
FIG. 3 is a perspective view of a construction block wall showing three spaced-apart insulation fasteners projecting therefrom and an insulation panel that is about to be installed against the wall.

After a course of block 62 is laid down, a worker installs the fasteners 10 in a temporary fashion, as previously described, on the outer wall 24 of every other block 18 in the course 62 so as to extend into the crawl space 68, as shown in FIG. 3. Once the fasteners 10 are installed in this temporary fashion and positioned on the course of block 62, mortar 64 is laid down along the top face 28 and over the fastener 10 in conventional fashion. The next course of block 66 is then laid down over the course of block 62. In this fashion, the course of block 66 cooperates with the course of block 62 and the mortar 64 therebetween to permanently hold the fastener 10 in position. It would also be conceivable for the fastener 10 of the present invention to be anchored to the bottom of a block 18 before the block 18 is laid down in a course, thereby forming an upright U-shaped channel.

FIG. 3 shows a wall 20 with fasteners 10 installed. The third segments 48 and tapered panel piercing flanges 12 are exposed and positioned to engage the insulation panel 16. Preferably, the fasteners 10 are installed one course below the top plate 70. This allows room for a sufficient amount of insulation 16 above and below the fastener 10 to apply leverage, in conjunction with the fastener 10, to retain the insulation panel 16 against the wall 20. However, depending on the situation, other arrangements may be suitable. In the event a higher wall is needed, for example a basement wall, the fasteners 10 would preferably be placed one course down from the top course and every other course downward from there. Again, the fasteners 10 would be located on every other block 18 lengthwise along the wall.

Figure 6:
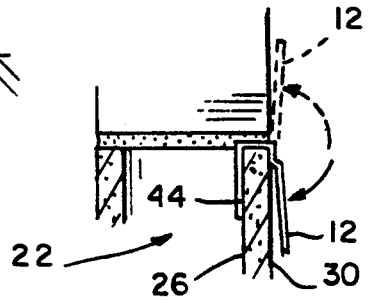
FIG. 6 is a side elevation showing the insulation fastener of FIGS. 1-5 attached to the construction block ad the range of movement of the deformable panel-piercing end of the fastener.

As shown in FIG. 6, the panel piercing flange 12 can be bent upwardly or downwardly until required to penetrate insulation 16, at which time panel piercing flange 12 can be bent to extend orthogonally from the wall 20. The insulation panel 16 then need only be cut to size to fit the wall 20 to be covered and pushed against the wall 20.

When the insulation panel 16 is ready to be installed against the block wall 20, the bottom edge 80 of the insulation panel 16 is positioned against the footing 82 at the base of the wall 20. The insulation panel 16 is then pivoted in direction 84 into position against the wall 20, as shown in FIG. 3. Once positioned, the inner face 26 of the insulation panel 16 lies adjacent to the outer face 30 of the blocks 18 and the top edge 86 of the insulation panel 16 abuts the bottom of the floor joists 72. The final position of the insulation panel 16 is shown in dotted lines at 88 in FIG. 4. The panel piercing flange 12 penetrates and passes through the insulation panel 16. Advantageously, the third segment 48 prevents the fastener 10 from being pushed in toward the interior of the wall 20 by the insulation panel 16, and holds the fastener 10 in position so that it is able to penetrate the insulation panel 16.

Figure 5:
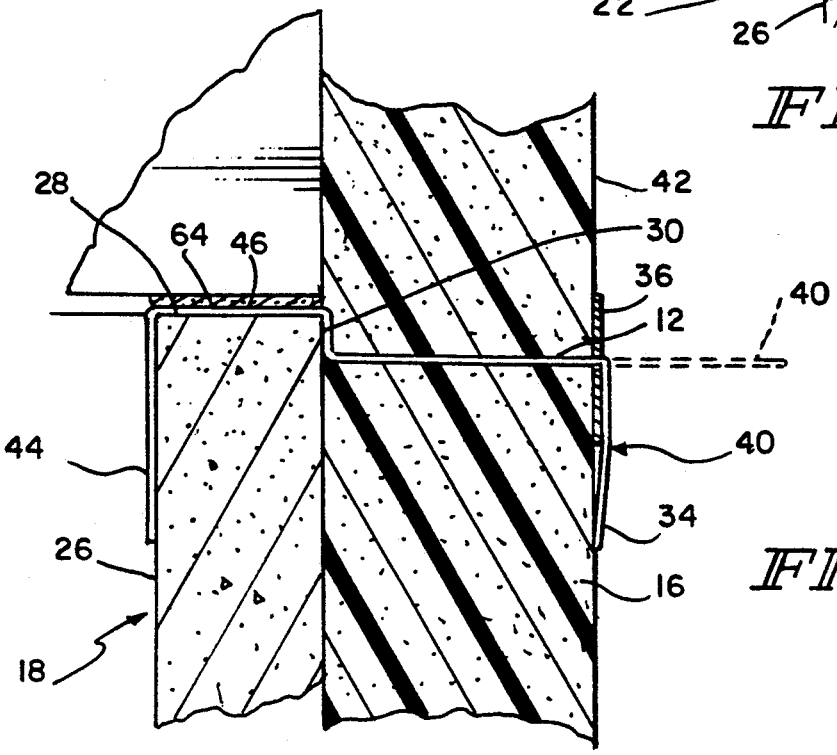
FIG. 5 is an enlarged view of the block foundation of FIG. 4 showing one end of the fastener anchored to the block foundation and the other end projecting through the insulation panel and an external panel and bent downwardly to hold the panel in place against the block foundation.

When the insulation panel 16 is in place against the wall 20, the end 34 of the panel piercing flange 12 projects outwardly from the outer face 42 of the insulation panel 16. The washer 36 is slid over the panel piercing flange 12 so that the end 34 of the panel piercing flange 12 passes through the rectangular aperture 38 of the washer 36, as shown in FIG. 2. The washer 36 is operably positioned to abut the outer face 42 of the insulation panel 16. The end 34 of the panel piercing flange 12 is bent upwardly or downwardly to form the washer retaining tab 40. The washer retaining tab 40 operably lies in parallel spaced-apart relation to the block wall 20 and holds the washer 36 adjacent the outer face 42 of the insulation panel 16, as shown in FIG. 5.

Figure 7:
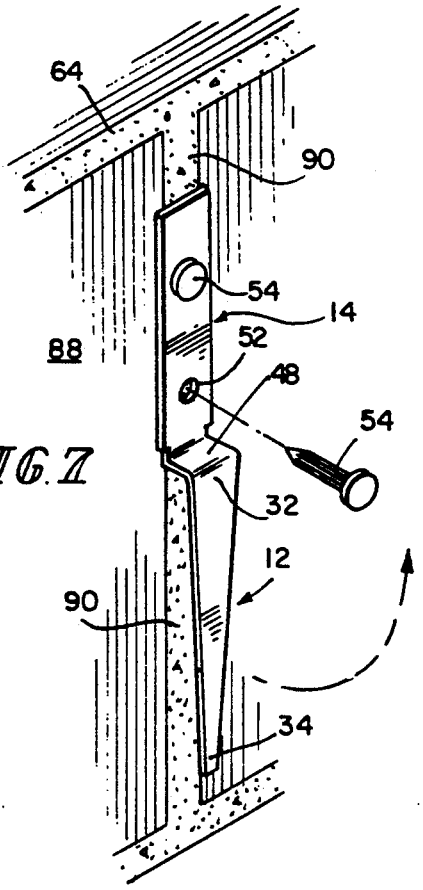
FIG. 7 shows another embodiment of an insulation fastener in accordance with the present invention for use in a preexisting wall.
Figure 8:
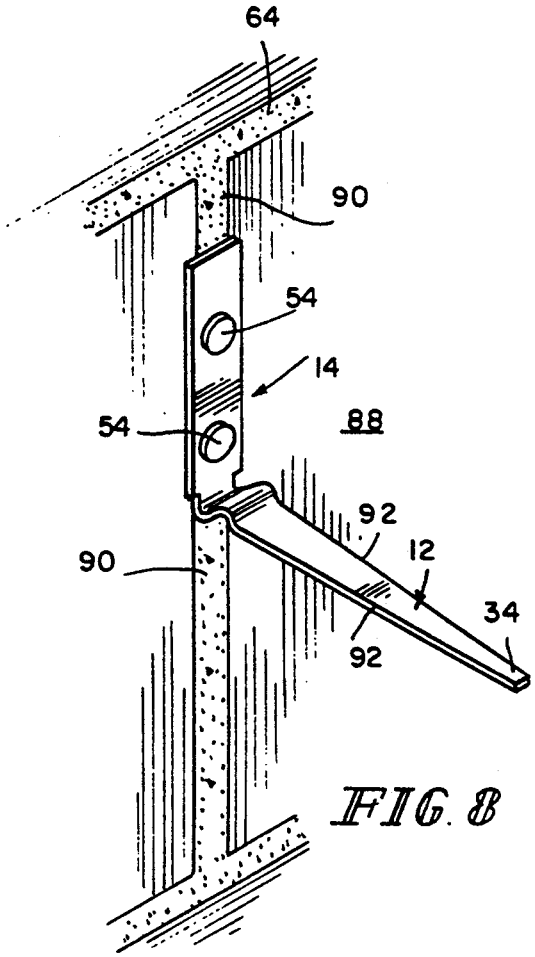
FIG. 8 shows the embodiment of FIG. 7 with the panel piercing end of the fastener bent to project outwardly from the wall to receive an insulation panel.

As presently envisioned, the insulation 16 fastener 10 of the present invention is to be installed during the construction of the block wall 20. However, it is easily adaptable for use with a preexisting wall 88, as shown in FIGS. 7 and 8. In the case of a preexisting wall 88, the anchoring flange 14 is vertically oriented and placed adjacent the vertical seam 90 between adjacent blocks 18. Means for permanently attaching the fastener 10 to the mortar 64, preferably masonry nails 54, pass through the apertures 52 formed on the anchoring flange 14 and into the mortar 64 in the vertical seam 90 of the preexisting wall 88. The panel piercing flange 12 is operably bent horizontally to extend outwardly from the preexisting wall 88 to penetrate the insulation panel 16 and be mechanically coupled thereto, as already described.

Although the invention has been described in detail with reference to certain preferred embodiments, variations and modifications exist within the scope and spirit of the invention as described and defined in the following claims.

I claim:

1. An insulation fastener system for supporting insulation, the insulation fastener system comprising a block having a top and a hollow inner core, means for piercing the insulation, and means for anchoring the fastener to the block, wherein the anchoring means is attached to the piercing means and includes first segment means for engaging the block and lying inside the hollow inner core of the block and second segment means for engaging the top of the block, the second segment means being disposed between the first segment means and the piercing means.

2. The insulation fastener system of claim 1, wherein the anchoring means further includes third segment means for engaging the block, the third segment means extends orthogonally from the second segment, and the first, second, and third segment means cooperate to define a generally U-shaped channel.

3. The insulation fastener system of claim 2, wherein the generally U-shaped channel is inverted.

4. The insulation fastener system of claim 2, wherein the piercing means further comprises a flange that extends orthogonally from the third segment means and continuously tapers from a maximum width at one end adjacent to the third segment means to a minimum width at another end of the flange.

5. An insulation fastener with a construction block having a hollow inner core and an outer wall, the outer wall having an inner face adjacent the inner core, an outer face and a top face, the insulation fastener comprising:

means for anchoring the fastener to the block, wherein the anchoring means includes first segment means for lying inside the inner core and adjacent to the inner face of the block upon attachment of the fastener to the block and second segment means coupled to the first segment means for engaging the top of the block upon attachment of the fastener to the block and third segment means coupled to the second segment for engaging the outer face of the block upon attachment of the fastener to the block, the first, second, and third segment means cooperating to define a generally U-shaped channel means for gripping the outer wall of the block, and the first, second, and third segment means are arranged in serial relation to position the second segment means between the first and third segment means.

6. The insulation fastener of claim 5, further comprising means for piercing the insulation, wherein the piercing means has one end attached to the third segment means at a point of attachment and extends orthogonally therefrom and continuously converges from the point of attachment to another end.

7. The insulation fastener of claim 5, wherein the generally U-shaped channel means is inverted.

8. A method of using an insulation fastener with a construction block wherein the block has a wall and an inner core, the wall having an inner face adjacent to the inner core, an outer face, and a top face, the fastener having first, second, and third segments, the method comprising positioning the fastener adjacent to the block so that the second segment is adjacent to the outer face and a portion of the first segment is adjacent to the top face, bending a second portion of the first segment into the inner core so that the second portion is positioned adjacent to the inner face of the block to form a hook gripping the block, and pushing insulation against the fastener so that the third segment penetrates the insulation.

9. The method of claim 8, wherein the first, second, and third segments are arranged in series to position the second segment between the first and third segments.

10. The method of claim 9, wherein each of the first, second, and third segments are flat.

11. The method of claim 8, wherein each of the first, second, and third segments are flat.

12. The method of claim 8, wherein the first and second portion of the first segment are coplanar prior to completion of the bending step.

13. The method of claim 12, wherein the first portion of the first segment and the second segment lie in spaced-apart parallel relation after completion of the bending step.

14. The method of claim 13, wherein the second portion of the first segment is perpendicular to each of the first portion of the first segment and the second segment after completion of the bending step.

15. The method of claim 8, wherein the second portion of the first segment and the third segment are arranged to lie in parallel relation before and after completion of the bending step.

16. The method of claim 8, wherein the second and third segments are arranged to lie in perpendicular relation during the pushing step.

17. An insulation fastener for attaching insulation to a wall, the insulation fastener a block have a top and a hollow inner core, comprising first, second, and third segments arranged in serial relation to position the second segment between the first and third segments, the first and third segments lying in spaced-apart parallel relation to one another and in perpendicular relation to the second segment to define a U-shaped block-mounting portion, the third segment including a first end appended to the second segment and an opposite second end, the first segment lying in the hollow inner core and a fourth segment having a proximal end appended to the second end of the third segment and a pointed distal end configured to provide means for puncturing insulation, the fourth segment lying in spaced-apart parallel relation to the second segment and in perpendicular relation to the third segment.

18. The insulation fastener of claim 17, wherein each of the first, second, third, and fourth segments are flat.

19. The insulation fastener of claim 17, wherein each of the first, second, and third segments are flat.

20. The insulation fastener of claim 17, wherein the third segment has a preset length extending between the first and second ends and the fourth segment has a length extending between the proximal and distal ends that is about seven times longer than the length of the third segment.

21. A method of using an insulation fastener with a construction block wherein the block has a wall and an inner core, the wall having an inner face adjacent to the inner core, an outer face, and a top face, the fastener having in series four segments, the method comprising the steps of:

positioning a first of the four segments inside the inner core and adjacent to the inner face of the block, engaging a second of the four segments to the top of the block, contacting a third of the four segments against the outer face of the block, the second segment interconnecting the first and third segment, and projecting a fourth of the four segment to extend in a direction away from the outer face of the block, the third segments interconnecting the second and fourth segments, wherein the contacting step is completed before completion of the positioning step.

22. A method of using an insulation fastener with a construction block wherein the block has a wall and an inner core, the wall having an inner face adjacent to the inner core, an outer face, and a top face, the fastener having in series four segments, the method comprising the steps of:

positioning a first of the four segments inside the inner core and adjacent to the inner face of the block, engaging a second of the four segments to the top of the block, contacting a third of the four segments against the outer face of the block, the second segment interconnecting the first and third segment, and projecting a fourth of the four segment to extend in a direction away from the outer face of the block, the third segments interconnecting the second and fourth segments, wherein the engaging and contacting steps are completed before completion of the positioning step.

* * * * *